United States Patent [19]

Bayer

[11] Patent Number: 4,554,525

[45] Date of Patent: Nov. 19, 1985

[54] THERMAL SWITCH

[75] Inventor: Helmut Bayer, Vienna, Austria

[73] Assignee: Electrovac Fabrikation Electrotechnischer Spezialartikel Gesellschaft mbH, Vienna, Austria

[21] Appl. No.: 471,108

[22] Filed: Mar. 1, 1983

[30] Foreign Application Priority Data

Mar. 3, 1982 [AT] Austria ..... 831/82

[51] Int. Cl.[4] ..... H01H 37/52

[52] U.S. Cl. ..... 337/356; 337/348; 337/354

[58] Field of Search ..... 337/356, 354, 348, 343, 337/345, 365, 367, 372

[56] References Cited

U.S. PATENT DOCUMENTS

| | | | |
|---|---|---|---|
| 3,081,388 | 3/1963 | Cox | 337/354 |
| 3,322,920 | 5/1967 | Morris | 337/365 |
| 3,660,793 | 5/1972 | Them et al. | 337/367 |

FOREIGN PATENT DOCUMENTS

| | | |
|---|---|---|
| 354140 | 12/1979 | Austria . |
| 2715728 | 10/1977 | Fed. Rep. of Germany . |

*Primary Examiner*—Harold Broome
*Attorney, Agent, or Firm*—Martin A. Farber

[57] ABSTRACT

A thermal switch having a temperature sensor formed of a thermal bimetallic snap disk, the temperature sensor cooperating via a transmission member with a contact system which has a contact carrier bearing at least one movable contact, the movable contact resting under spring force in its closed-circuit position of rest against at least one fixed contact. A locking member is provided which, upon a temperature-caused movement of the transmission member, is displaceable under spring force in the direction towards the transmission member at least approximately perpendicular to the direction of displacement of the transmission member and holds the contact carrier in its open-circuit position after temperature-caused movement of said support.

12 Claims, 6 Drawing Figures

THERMAL SWITCH

The present invention relates to a thermal switch having a temperature sensor formed of a thermal bimetallic snap disk, the temperature sensor cooperating via a transmission member with a contact system which has a contact carrier bearing or forming at least one movable contact, the movable contact resting under spring force in its position of rest against at least one fixed contact, a locking member being provided which, upon a temperature-caused movement of the transmission member, is displaceable under spring force in the direction towards the transmission member at least approximately perpendicular to the direction of displacement of said transmission member and holds the contact carrier in its end position after a temperature-caused movement of said support.

Thermal switches are frequently used as temperature limiters, where they have the function of disconnecting an electrically heated appliance or turning on an alarm device when a maximum permissible temperature is reached. In the thermal switches of customary construction, the electrically heated appliance is generally again automatically reconnected or the alarm device turned off when the temperature declines from the maximum value which it has reached. This reconnecting of the appliance or disconnecting of the alarm takes place even when the cause for the increase in the temperature up to the maximum permissible value resides in a defective appliance and therefore even when the defect has not been eliminated.

In order to avoid this disadvantage, thermal switches are already known in which there is provided an escapement device which is under the action of a spring and acts at least approximately perpendicular to the direction of movement of the transmission member, this escapement member, upon or after displacement of the transmission member by the temperature-caused movement of the thermal bimetallic element, preventing a change in the switch condition of the contact system which has been reached thereby.

Thus from U.S. Pat. No. 3,081,388 there is known a thermal switch in which an escapement device, developed essentially as locking member, acts on a movable spring of the contact system. The locking member, which is under the force of a spring, rests against the contact spring and is provided for this purpose with a projection. If the contact spring is pressed upward by the thermal bimetallic element via the transmission member, the projection engages below the contact spring so that the latter is held fast in this position even if the thermal bimetallic element again assumes the initial position.

From Austrian Pat. No. 354,140 a thermal switch is known in which the escapement device acts directly on the transmission member.

The known thermal switches are relatively expensive. This constitutes a considerable disadvantage, particularly in the case of small electrical appliances since the installing of such a switch results in a considerable increase in price. This is true among other things particularly in the case of electric irons, for instance in which protection against overheating is of utmost importance. The temperature controllers which are installed in electric irons, and by which the temperature of the iron is adjustable depending on the material to be ironed may fail, particularly after lengthy use, resulting in overheating resulting in the danger of a fire.

The object of the invention is, accordingly, to create as simple and inexpensive a thermal switch as possible which is suitable for mass production but which nevertheless operates dependably and is insensitive to blows.

In accordance with the present invention, in a thermal switch of the aforementioned type, the point of action of the thermal bimetallic snap disk on the transmission member is on that end of the transmission member which faces away from the contact system and has two support points of the thermal bimetallic snap disk at least approximately in a plane lying parallel to the direction of displacement of the transmission member, the one support point lying on that edge of the thermal bimetallic snap switch which is opposite the point of attack and the second point of support lying between the point of attack and the first support point, while the locking member is arranged at that end of the transmission member which faces away from the contact system.

By this measure not only is the desired purpose achieved but, due to the fact that the point of attack of the thermal bimetallic snap switch is arranged at that end of the transmission member facing away from the contact system with two support points of the thermal bimetallic snap switch at least approximately in a plane lying parallel to the direction of displacement of the transmission member, the one support point lying on the edge of the thermal bimetallic snap disk which is opposite the point of attack and the second support point lying between the point of attack and the first support point, there is obtained for the actuation of the transmission member by the thermal bimetallic snap disk a one-armed lever which is swingably supported on the first support point, with the second support point forming the point of attack of the force which swings the lever and is determined by the temperature-caused change in shape of the thermal bimetallic snap disk. The distance of this point of attack from the first support point forms the load arm of the lever and the distance of the second support point from the first support point forms the force arm. The path of displacement of the end of the load arm, which is controlling for the path of the movable contact of the contact system and acts on the transmission member, is greater the closer the second support point is to the first support point.

Due to the fact that the locking member is arranged at the end of the transmission member which faces away from the contact system, a sufficiently large distance of the locking member from the contact system and thus from its contacts is obtained.

The displacement path of the point of attack of the thermal bimetallic snap disk on the end of the transmission member facing away from the contact system is advantageously greater than the length parallel to the longitudinal direction of the transmission member of the part of the locking member which produces the locking due to which the result is obtained that the locking member, after a temperature-caused deformation of the thermal bimetallic snap disk, definitely prevents the return movement of the contact system into its initial position.

This is advantageously achieved in the manner that the locking member engages in its locking position below the transmission member or the thermal bimetallic snap disk.

The invention will be explained in further detail with reference to the drawing, which diagrammatically shows two illustrative embodiments.

Figure 4:
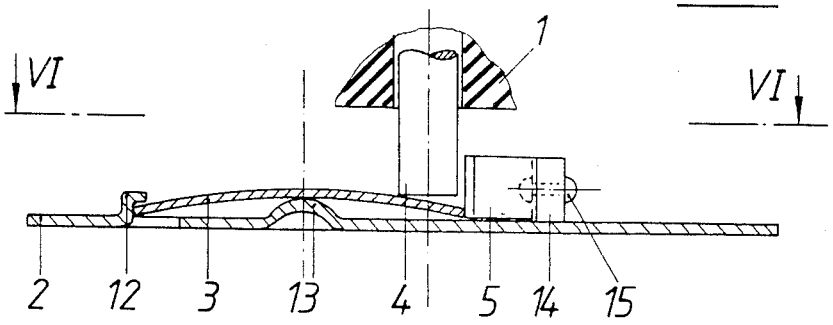
Figure 5:
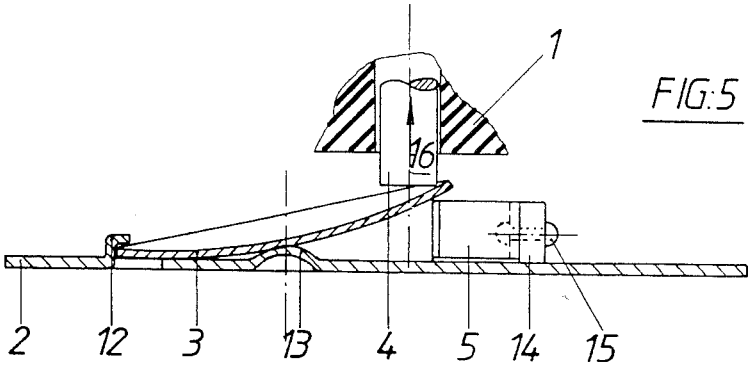
Figure 6:
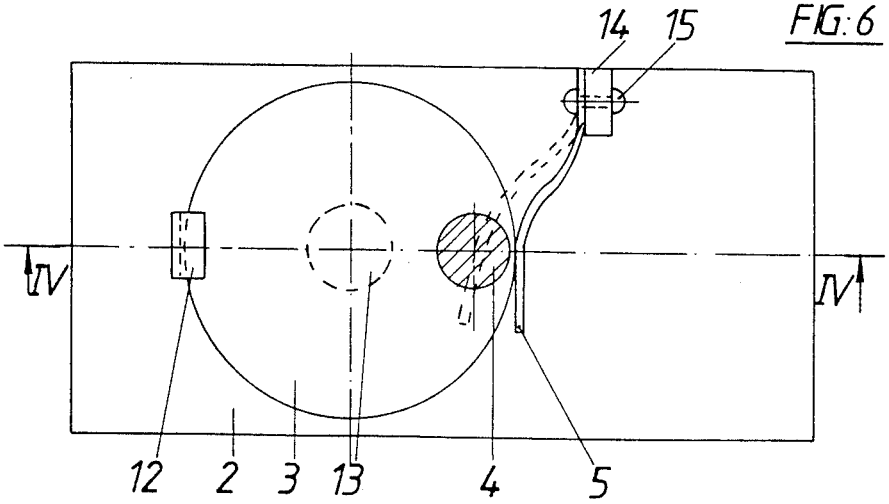

FIGS. 4 to 6 show a second embodiment, with only those parts of the thermal switch being shown which represent the displacement mechanism of the transmission member, FIG. 4 being a cross-section along the line IV—IV of FIG. 6 in the initial position, FIG. 5 a cross-section along the line IV—IV of FIG. 6 in the position after a temperature-caused deformation of the thermal bimetallic snap disk, and FIG. 6 a cross-section along the line VI—VI of FIG. 4.

Figure 1:
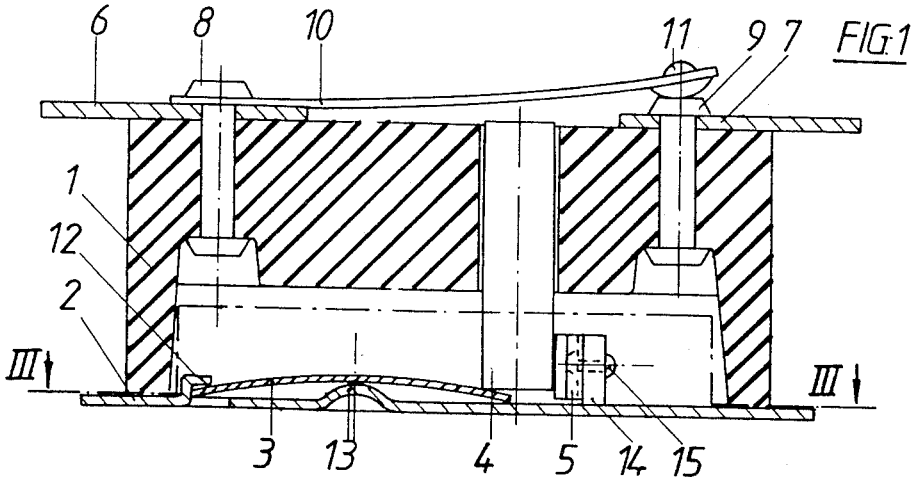
FIG. 1 is a section along the line I—I of FIG. 3 of a thermal switch in accordance with the invention, shown in its initial position.
Figure 2:
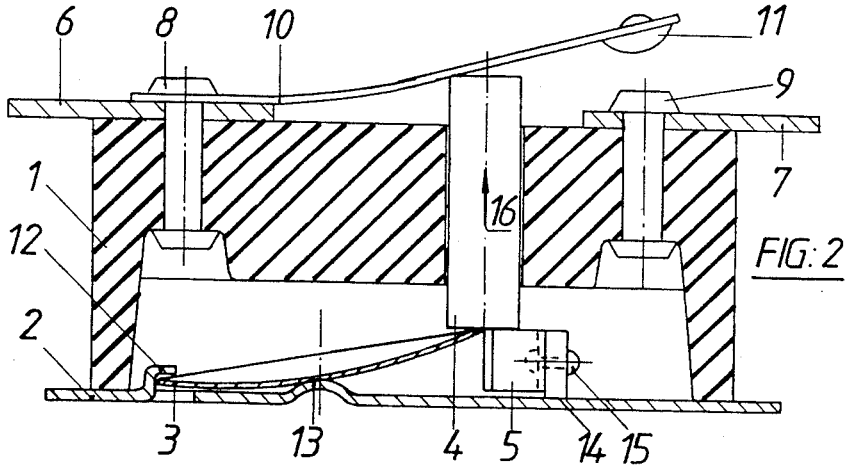
FIG. 2 shows the thermal switch in its position after a temperature-caused deformation of the thermal bimetallic snap disk.
Figure 3:
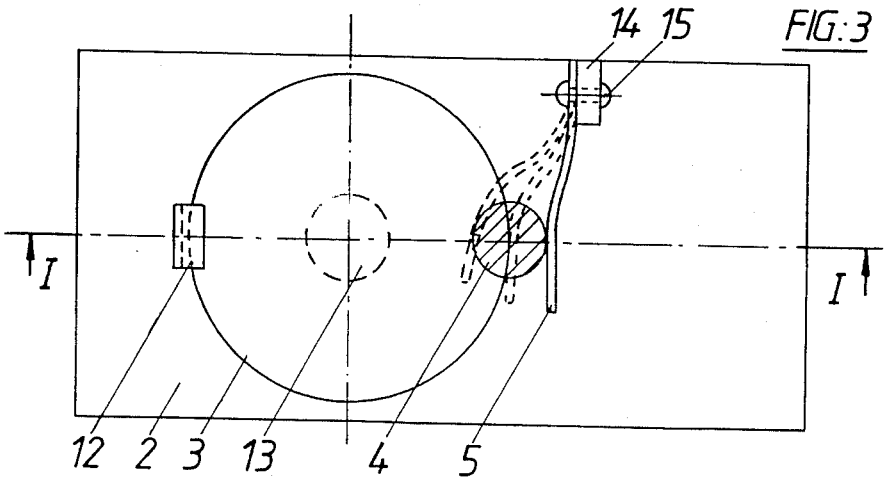
FIG. 3 is a cross-section along the line III—III of FIG. 1.

The embodiment shown in FIGS. 1 to 3 has a housing 1 which is provided with a bottom plate 2. Within the housing there is a thermal bimetallic snap disk 3 which cooperates with a transmission member 4 which can be locked by a locking member 5 after a temperature-caused movement of the transmission member 4. The transmission-member 4 cooperates with a contact system which has two terminal lugs 6, 7, the terminal lug 6 being fastened by a rivet 8 to the housing 1. The terminal lug 7 is also fastened to the housing 1 by a rivet which forms the stationary contact 9 of the contact system. The rivet 8 also serves to fasten a spring contact carrier 10 to the housing 1, said carrier bearing a movable contact 11 which is opposite the stationary contact 9. The contacts 9, 11 are in contact in the position of rest.

The thermal bimetallic snap disk 3 is mounted at two support points 12, 13 on the bottom plate 2. The one support point 12 holds the edge of the thermal bimetallic snap disk 3 against the bottom plate 2 while the second support point 13 is formed by a bulge in the bottom plate 2 on which bulge the thermal bimetallic snap disk 3 rests. The edge of the thermal bimetallic snap disk 3 which is opposite the first support point 12 lies below that end of the transmission member 4 which faces away from the contact system and against which the locking member 5 rests in the initial position shown in FIG. 1. The locking member 5 consists of a leaf spring which presses against the transmission member 4 and is fastened to a locking-member mount 14 by a rivet 15.

The point of attack of the thermal bimetallic snap disk 3 on the transmission member 4 is thus arranged at that end of the transmission member 4 facing away from the contact system in the same plane as the two support points 12, 13 of the thermal bimetallic snap disk 3, the center line of the transmission member 4 also lying in said plane and the second support point 13 being arranged between the first support point 12 and the point of attack of the thermal bimetallic snap disk 3 on the transmission member 4. In this way there is formed a single-arm lever whose force arm is formed by the two support points 12, 13 and whose load arm is formed by the first support point 12 and the point of attack of the thermal bimetallic snap disk 3 on the transmisson member 4.

In the initial position shown in FIG. 1 and in solid line in FIG. 3, that edge of the thermal bimetallic snap disk 3 which faces away from the first bearing point 12 is located below the transmission member 4, the thermal bimetallic snap disk 3 being curved in the direction towards the contact system, the movable contact 11 resting against the stationary contact 9 and a circuit connected to the terminal lugs 6, 7 being closed. In this initial position the locking member 5 rests against the outer periphery of the transmission member 4.

If the thermal bimetallic snap disk 3 is now heated, it snaps into the position shown in FIG. 2 when the snap temperature is reached, as a result of which the transmission member 4 is moved in the direction of the arrow 16 and the contact carrier 10 is displaced so that the contacts 9, 11 are moved apart and the closed circuit is therefore opened. In this case the locking member 5, as shown in dashed line in FIG. 3, engages below the transmission member 4, as a result of which the latter is held in the position in which the contacts 9, 11 are separated from each other.

If the thermal bimetallic snap disk 3 is now cooled again, it snaps back into the position shown in FIG. 1 when the corresponding snap temperature is reached. The locking member 5, however, still engages below the transmission member 4 so that even after the cooling of the thermal bimetallic snap disk 3 the contacts 9, 11 are held in their position apart from each other.

If the thermal switch is to be brought again into its initial position shown in FIG. 1, then the locking member must be forced away from the transmission member, for instance by means of a tool, so that the transmission member is brought into the position shown in FIG. 1 under the force of the spring contact carrier 10.

In the embodiment shown in FIGS. 4 to 6, parts which are equivalent to the parts in the embodiment shown in FIGS. 1 to 3 have been provided with the same reference numbers.

The embodiment in accordance with FIGS. 4 to 6 differs from the embodiment of FIGS. 1 to 3 first of all by the fact that the locking member 5, as shown in FIGS. 4 to 6, does not press against the transmission member 4 in the initial position but, rather, against the end surface of the thermal bimetallic snap disk 3. The transmission member 4 merely rests under the force of the spring contact carrier 10 (FIG. 1) on the thermal bimetallic snap disk 3.

After a temperature-caused deformation of the thermal bimetallic snap disk 3, the locking member 5 does not engage directly below the transmission member 4, as is the case in the embodiment shown in FIGS. 1 to 3, but rather below the thermal bimetallic snap disk 3. After a drop in the temperature, the thermal bimetallic snap disk 3 remains in the position shown in FIG. 5, assuming, to be sure, the shape shown in FIG. 4.

I claim:

1. In a thermal switch having a temperature sensor formed of a thermal bimetallic snap disk, said temperature sensor cooperating via a displaceable transmission member with a contact system which has a displaceable contact carrier bearing at least one movable contact, the movable contact resting under spring force in its closed-circuit position of rest against at least one fixed contact, and a locking member being provided which, upon a temperature-caused movement of the transmission member, is displaceable, under spring force, in the direction towards the transmission member at least approximately perpendicular to the direction of displacement of said transmission member and holds the contact carrier fast in its open-circuit end position after a temperature-caused movement of said carrier, the improvement comprising said disk having a point of attack upon said transmission member, which point of attack lies on that end of said transmission member which faces away from the contact system, said disk being arranged with two support points at least approximately in a plane lying parallel to the direction of displacement of said transmission member, a first said support point lying on that edge of said disk which is opposite said point of attack and a second said support point lying between said point of attack and said first support point, and said locking member being arranged at that end of said transmission member which faces away from said contact system.

2. The thermal switch according to claim 1, wherein the path of displacement of said point of attack of said disk, at that end of said transmission member facing away from said contact system, is greater than the length of the part of the locking member producing the locking which is parallel to the longitudinal direction of said transmission member.

3. The thermal switch according to claim 2, wherein the locking member engages below said transmission member in the locking position.

4. The thermal switch according to claim 2, wherein the locking member engages below said disk in the locking position.

5. A thermal switch comprising:

a temperature sensor, a transmission member, a switchable contact system, said system having a fixed contact and a displaceable carrier, said carrier defining a second contact cooperable with said fixed contact, said second contact being displaceable by said carrier under spring tension, said transmission member being displaceable by action of said temperature sensor and when displaced by such action, cooperating with said carrier to displace said second contact, a locking member, said locking member operable in a locking position to effectively maintain carrier-caused displacement of said second contact, a housing with a bottom plate, said plate defining first and second support points for said sensor, and wherein said sensor acts upon a first end of said transmission member, said first support point lying on an edge of said sensor which is distant from said first end of said transmission member, and said second support point lying intermediate said first support point and said first end of said transmission member.

6. The thermal switch according to claim 5, wherein said locking member is arranged to act upon said first end of said transmission member.

7. The thermal switch according to claim 6, wherein said transmission member is displaceable by said sensor in an amount greater than the clearance required to permit said locking member to be displaced into the path of said transmission member.

8. A thermal switch comprising:

a temperature sensor, a transmission member, a switchable contact system, said system having a fixed contact and a displaceable carrier, said carrier defining a second contact cooperable with said fixed contact, said second contact being displaceable by said carrier under spring tension, said transmission member being displaceable by action of said temperature sensor and when displayed by such action, cooperating with said carrier to displace said second contact, a locking member, said locking member operable in a locking position to effectively maintain carrier-caused displacement of said second contact, and wherein said temperature sensor comprises a thermal bimetallic snap disk, said fixed and said second contact are in electrical contact with each other prior to displacement of said transmission member by temperature-caused action of said disk, and wherein said locking member, upon temperature-caused displacement of said transmission member, engages said disk below said transmission member in said locking position.

9. A thermal switch comprising:

a temperature sensor, a transmission member, a switchable contact system, said system having a fixed contact and a displaceable carrier, said carrier defining a second contact cooperable with said fixed contact, said second contact being displaceable by said carrier under spring tension, said transmission member being displaceable by action of said temperature sensor and when displaced by such action, cooperating with said carrier to displace said second contact, and a locking member, said locking member operable in a locking position to effectively maintain carrier-caused displacement of said contact, wherein said temperature sensor comprises a thermal bimetallic snap disc, said locking member, upon temperature-caused displacement of said transmission member, is displaceable into said locking position in the path of said transmission member to effectively maintain said displacement of said second contact, said locking member operates under spring tension, said disk acts upon an end of said transmission member, which end is a distant end from said carrier, said switch further comprises a housing with a bottom plate, said plate defining first and second support points for said disk, said disk acts upon the carrier-distant end of said transmission member, said first support point lying on an edge of said disk which is distant from the carrier-distant end of said transmission member, said second support point lying intermediate said first support point and the carrier-distant end of said transmission member, said locking member is arranged to act upon the carrier-distant end of said transmission member, and said transmission member is displaceable by said disk in an amount greater than the clearance required to permit said locking member to be displaced into the path of said transmission member.

10. The thermal switch according to claim 9, wherein said spring tension of said locking member permits deflection of said locking member by means of a tool to accomplish a resetting of said locking member into a non-lock position.

11. The thermal switch according to claim 9, wherein said spring tension of said locking member permits resetting of said locking member by displacing said locking member into a non-lock position.

12. The thermal switch according to claim 11, wherein said locking member, upon temperature-caused displacement of said transmission member, engages said disk below said transmission member in said locking position.

* * * * *